US009702609B2

(12) United States Patent
Robb et al.

(10) Patent No.: US 9,702,609 B2
(45) Date of Patent: Jul. 11, 2017

(54) VESSEL COOLING SYSTEM AND ASSOCIATED METHODS

(71) Applicant: COLD CAN INNOVATIONS, LLC, Gibsonia, PA (US)

(72) Inventors: Michael P. Robb, Gibsonia, PA (US); Thomas Osborne, Trenton, OH (US)

(73) Assignee: COLD CAN INNOVATIONS, LLC, Gibsonia, PA (US)

( * ) Notice: Subject to any disclaimer, the term of this patent is extended or adjusted under 35 U.S.C. 154(b) by 237 days.

(21) Appl. No.: 14/740,689

(22) Filed: Jun. 16, 2015

(65) Prior Publication Data

US 2015/0362248 A1 Dec. 17, 2015

Related U.S. Application Data

(60) Provisional application No. 62/013,137, filed on Jun. 17, 2014.

(51) Int. Cl.
*F25D 3/08* (2006.01)
*A47G 19/22* (2006.01)

(52) U.S. Cl.
CPC ..... *F25D 3/08* (2013.01); *A47G 19/2288* (2013.01); *F25D 2303/0821* (2013.01); *F25D 2303/0845* (2013.01); *F25D 2331/803* (2013.01); *F25D 2331/805* (2013.01); *F25D 2331/809* (2013.01)

(58) Field of Classification Search
CPC ..... F25D 3/08; F25D 2303/0821; F25D 2303/0845; F25D 2331/805; F25D 2331/809; F25D 2331/803; A47G 19/2288
See application file for complete search history.

(56) References Cited

U.S. PATENT DOCUMENTS

| | | | |
|---|---|---|---|
| 2,926,508 | A | 3/1960 | Moon |
| 3,302,428 | A | 2/1967 | Stoner et al. |
| 3,807,194 | A | 4/1974 | Bond |
| 4,163,374 | A | 8/1979 | Moore et al. |
| 4,255,944 | A | 3/1981 | Gardner et al. |
| 4,293,015 | A | 10/1981 | McGough |
| 4,299,100 | A | 11/1981 | Crisman et al. |

(Continued)

OTHER PUBLICATIONS www.chillpuck.com, © 2013 CP Concepts.

*Primary Examiner* — Emmanuel Duke
(74) *Attorney, Agent, or Firm* — Mark Malek; Kelly G. Swartz; Widerman Malek, PL

(57) ABSTRACT

A vessel cooling system may include a beverage holding device, having a bottom with a slit having a length. The system may also include a cooling device, having a convex top configured to be received by a concave bottom of a beverage vessel. The cooling device may have a top sheet of thermoplastic polyurethane, a bottom sheet of thermoplastic polyurethane affixed to the top sheet of thermoplastic polyurethane forming a cavity therebetween, and a shaped depression in the center of the convex top. The cooling device may further include a rigid portion, having a circumference, disposed on the bottom of the cooling device, a lip, having an upper surface with a plurality of raised ridges, formed on the circumference of the rigid portion and configured to contact the perimeter of the concave bottom of the beverage vessel, and coolant, that contracts as its temperature raises, contained within the cavity.

16 Claims, 5 Drawing Sheets

(56) References Cited

U.S. PATENT DOCUMENTS

| | | | | |
|---|---|---|---|---|
| 4,383,422 | A | 5/1983 | Gordon et al. | |
| 4,681,239 | A | 7/1987 | Manns et al. | |
| 4,745,776 | A * | 5/1988 | Clark | B65D 81/3886 62/372 |
| 4,910,977 | A | 3/1990 | Hilton | |
| 4,964,600 | A | 10/1990 | Lee | |
| 4,989,415 | A * | 2/1991 | Lombness | B65D 81/3886 62/372 |
| 5,212,963 | A * | 5/1993 | McGinnis | B65D 81/3876 62/372 |
| 5,361,604 | A | 11/1994 | Pier et al. | |
| 5,467,877 | A | 11/1995 | Smith | |
| 5,653,124 | A * | 8/1997 | Weber | A47G 19/2288 62/457.3 |
| 5,845,499 | A | 12/1998 | Montesanto | |
| 6,101,838 | A * | 8/2000 | Teague | F25D 3/08 62/371 |
| 6,147,337 | A | 11/2000 | Besser | |
| 6,196,017 | B1 | 3/2001 | Chapman | |
| 6,283,605 | B1 | 9/2001 | Kalamaras | |
| 6,398,061 | B2 | 6/2002 | Duff et al. | |
| 6,516,967 | B2 | 2/2003 | Duff et al. | |
| 6,786,062 | B1 * | 9/2004 | Greenberg | F25D 3/08 62/457.4 |
| 7,124,604 | B2 * | 10/2006 | Taylor | A47G 23/0313 62/457.4 |
| 7,331,194 | B2 | 2/2008 | Lefkowitz et al. | |
| 7,712,625 | B2 | 5/2010 | Alger | |
| 7,784,759 | B2 | 8/2010 | Farrell | |
| D649,836 | S | 12/2011 | Dooley et al. | |
| 8,162,170 | B1 * | 4/2012 | Massad | B65D 17/02 220/592.17 |
| 8,328,152 | B2 | 12/2012 | Jeffrey | |
| 8,365,941 | B2 * | 2/2013 | Mayer | A45F 3/18 206/217 |
| 8,448,809 | B2 | 5/2013 | Kelly | |
| 2002/0121104 | A1 | 9/2002 | Duff et al. | |
| 2004/0065109 | A1 * | 4/2004 | Metcalf | A47G 19/127 62/457.3 |
| 2006/0075770 | A1 | 4/2006 | Lefkowitz et al. | |
| 2007/0028645 | A1 | 2/2007 | Citrynell et al. | |
| 2007/0074532 | A1 * | 4/2007 | Kagen | F25D 3/08 62/457.2 |
| 2008/0087037 | A1 | 4/2008 | Rapaz | |
| 2010/0005828 | A1 * | 1/2010 | Fedell | F25D 3/08 62/457.4 |
| 2010/0147014 | A1 * | 6/2010 | Kim | A47G 19/027 62/457.6 |
| 2010/0218581 | A1 | 9/2010 | Khowaylo et al. | |
| 2011/0114646 | A1 | 5/2011 | Proskey | |
| 2013/0152622 | A1 | 6/2013 | Reisig et al. | |
| 2014/0054010 | A1 * | 2/2014 | Peters | F25D 31/002 165/104.11 |
| 2014/0166672 | A1 * | 6/2014 | Stroucken | B67B 7/00 220/592.01 |

* cited by examiner

VESSEL COOLING SYSTEM AND ASSOCIATED METHODS

RELATED APPLICATIONS

This application is related to and claims the benefit of U.S. Provisional Patent Application Ser. No. 62/013,137 titled VESSEL COOLING SYSTEM AND ASSOCIATED METHODS filed on Jun. 17, 2014, the entire contents of which are incorporated herein by reference.

FIELD OF THE INVENTION

The present invention relates to systems and methods for cooling a vessel containing liquid. More particularly, the invention relates to a cooling device for cooling a beverage.

BACKGROUND

When a cool beverage is held in its container, such as an aluminum can, for example, the liquid in the can may gradual approach the ambient temperature of the atmosphere or objects in contact with the container, such as a user's hand. This problem is exacerbated as the beverage is consumed. That is, as the volume of liquid decreases, the heat energy is absorbed by less liquid, which causes the temperature to rise more quickly than if the container were full. This situation can result in the remaining portion of the beverage becoming warmer than an optimal drinking temperature, which can cause discomfort or a reduced satisfaction with the consumer.

This background information is provided to reveal information believed by the applicant to be of possible relevance to the present invention. No admission is necessarily intended, nor should be construed, that any of the preceding information constitutes prior art against the present invention.

Beverages are often consumed in the outdoors. Especially in the summer, persons enjoy drinking various liquids in an attempt to cool themselves due to the excessive heat or otherwise. When drinking beverages outdoors in the summer, the surface of the beverage container may develop excessive condensation. Furthermore, the temperature of the liquid may increase rapidly when the ambient temperature is much greater than the temperature of the beverage. Therefore, oftentimes when a person chooses to enjoy an outdoor summertime (and sometimes an indoor or winter) beverage, that person may use a beverage insulator.

Beverage insulators serve multiple purposes. While beverage insulators typically provide users with an increased ability to keep the beverage at a lower temperature for a longer period of time, beverage insulators may also be used to increase a person's grip on the beverage container as well as provide a display device for advertisers or others. In order to provide a person with the ability to more easily grip a beverage container sweating condensation while also provide the ability to keep the beverage cooler than it would be without the insulator, beverage insulators are typically comprised of materials with a higher coefficient of friction than the beverage container while having insulating properties.

For example, many beverage insulators (often referred to as Koozie™ or coozie coolers) are comprised of Styrofoam, Neoprene, or other polymeric materials. Beverage insulator materials are typically adapted to keep the beverage at a lower temperature than the beverage would otherwise be at without the insulator, yet not be so thick that it decreases a user's ability to adequately grip the container. Different polymeric materials have the ability to insulate the beverage container at a relatively low thickness. Many of these beverage insulators are "sleeve" or "sheath" type devices that the beverage container may slide into or fit within. Therefore, the condensation which may occur on the beverage container will be kept within the inner portion of the sleeve, leaving the outer sleeve typically dry, allowing for increased grippage.

Although beverage insulators may ensure increased grippage for a user, their ability to keep a beverage at a lower temperature is oftentimes limited. For example, many insulators are fairly thin so that a user with small hands may be able grip the beverage once it is generally enclosed by the insulator. Thinning the insulator to increase grippage decreases insulation. Furthermore, Styrofoam and other polymers used as beverage insulators cannot protect the beverage from the heat during extremely hot days. Therefore, oftentimes beverage insulators, which may also be referred to as cozies, coozys, koozies, or other similar terms, may not be able to adequately perform the function they are supposed to perform. Prior art devices adapted to fit within beverage insulators to keep the beverage cold are deficient due to (i) their inability to keep a beverage cool, (ii) their lack of usability across multiple beverage containers, and (iii) that they are not environmentally safe, and (iv) they are not adapted to be used as a disposable or recyclable device.

SUMMARY OF THE INVENTION

With the foregoing in mind, embodiments of the present invention are related to a vessel cooling system that may be used in combination with beverage vessels, cooling devices, and beverage vessel holders. Furthermore, the vessel cooling system may advantageously combine a cooling device with a beverage vessel holder to enhance the cooling of beverages contained in vessels, as well as the experience of the drinker of the beverage.

These and other features and advantages according to an embodiment of the present invention are provided by a cooling device inserted between the bottom of beverage vessel and beverage holding device (referred to hereinafter as a koozie).

One or more slit 301 may be formed in the bottom portion of the koozie. The slit advantageously allows for the cooling device to be readily inserted into the koozie so that the cooling device may be positioned adjacent a bottom portion of the beverage vessel.

The cooling device includes a main body having a shaped design to conform to the bottom of a particular type of beverage container. The cooling device may have an essentially circular perimeter and may have a convex top sized to be received in the bottom of a beverage can.

The cooling device may also include a lip formed around a circumference of the cooling device. The main body forms a cavity in which a coolant is placed. In addition, exemplary embodiments of the cooling device may include a relatively rigid portion 106 on at least one side of the main body to allow the cooling device to remain relatively flat on one side once frozen.

The coolant is not particularly limited and may be water/ice or any other liquid or pliable material such as a gel, suspension, etc. While coolant can be frozen or cooled inside the main body before use, it is also possible to use other cooling principles, such materials which undergo an endothermic reaction to provide a heat dissipating effect.

In an embodiment of the vessel cooling system according to the present invention, the rigid portion of the cooling device can form the bottom of the cooling device and the lip may be formed on a circumference of the rigid portion. In addition, in some embodiments the coolant may be disposed between the rigid portion and main body.

Because the cooling device may be pliable, when the coolant begins melting, the beverage container may push down on the cooling device. This can create a vacuum effect which then causes the cooling device to adhere itself to the bottom of the beverage container. At this point no object, such as a koozie, is needed to hold the cooling device in place as a vacuum/suction effect has been developed between the beverage container and the koozie.

Additionally, the coolant can be formed of a material that contracts when changing from the solid/frozen/cold state to a liquid/warm state. For instance, water expands when frozen and contracts when thawed. This property can also help in creating a deformation in the main body to further promote a vacuum seal between cooling device 100 and the beverage container.

The main body can be formed to include a shaped depression in the center or so as to have areas or lines of greater flexibility/rigidity to encourage deformation into a certain shape upon melting of the coolant or pressure on the main body in order to facilitate the forming of a suction between the beverage container and the cooling device.

In some exemplary embodiments, a thermoplastic polyurethane or similar material can be made somewhat transparent to allow a user to observe when the coolant has melted. Additionally, because the material may be soft or flexible it can allow the user to squeeze or touch the cooling device to determine if the coolant has melted.

The lip may include raised ridges that are arranged in a pattern, but those skilled in the art will appreciate that the raised ridges of a cooling device need not be configured in any sort of pattern. The interaction between the lowermost portion of the can with the ridges provides a friction between the cooling device and the can so as to prevent or minimize movement of the can when engaged with the cooling device.

The overall diameter and pliability of the exemplary cooling device allows the device to be slid into a slit that may be formed in the bottom of the koozies, and similar devices. Fitting the cooling device through the slit of a koozie, even when there is a can/bottle present, allows the cooling device to be inserted and removed without causing undue stress on the koozie, or requiring the user to remove the beverage container from the koozie.

DETAILED DESCRIPTION OF THE INVENTION

Exemplary embodiments of the present invention will now be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Figure 1:
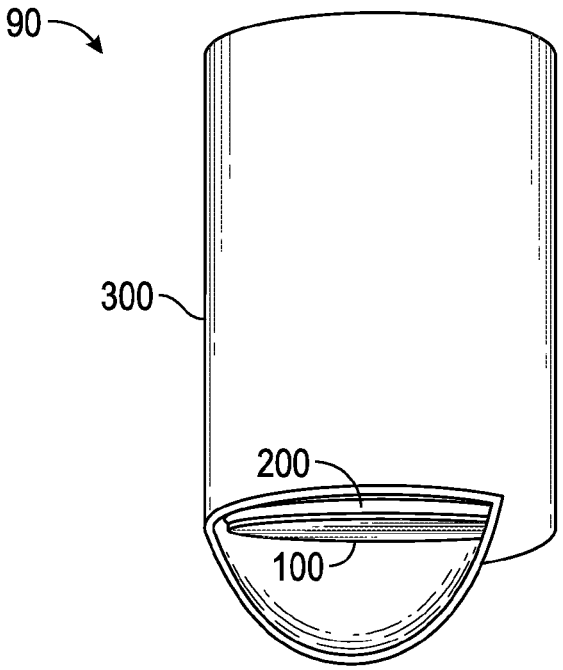
FIG. 1 is a perspective view of a vessel cooling system according to an embodiment of the present invention.
Figure 2:
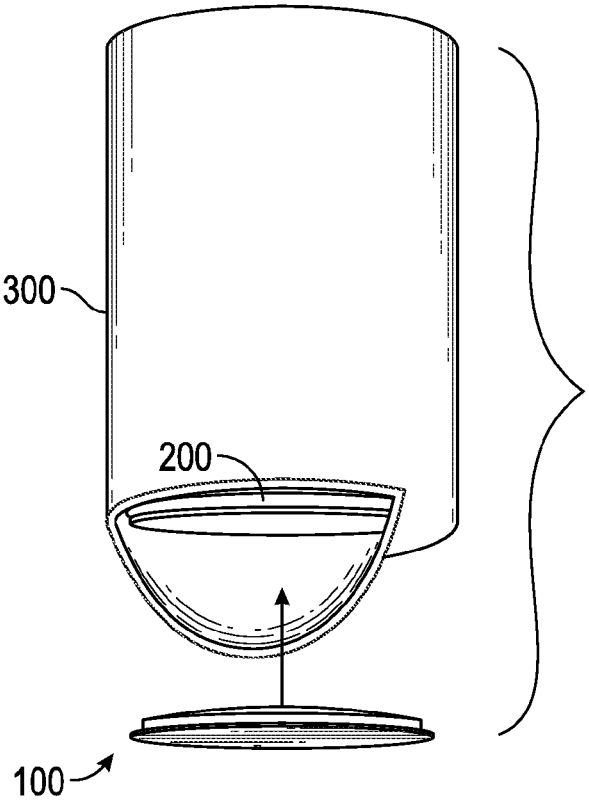
FIG. 2 is an exploded perspective view of the vessel cooling system illustrated in FIG. 1.

FIG. 1 illustrates an exemplary vessel cooling system 90 according to an embodiment of the present invention. The vessel cooling system 90 may include a cooling device 100 inserted between the bottom of beverage vessel 200 (also referred to as a beverage container and which may, for example, be provided by a can, such as an aluminum can, or a bottle that is typically used to contain a beverage) and beverage holding device 300 (referred to hereinafter as a koozie). FIG. 2 illustrates an exploded view of the vessel cooling system 90 according to an embodiment of the present invention and showing the cooling device 100 being removed from the koozie 300.

Figure 3:
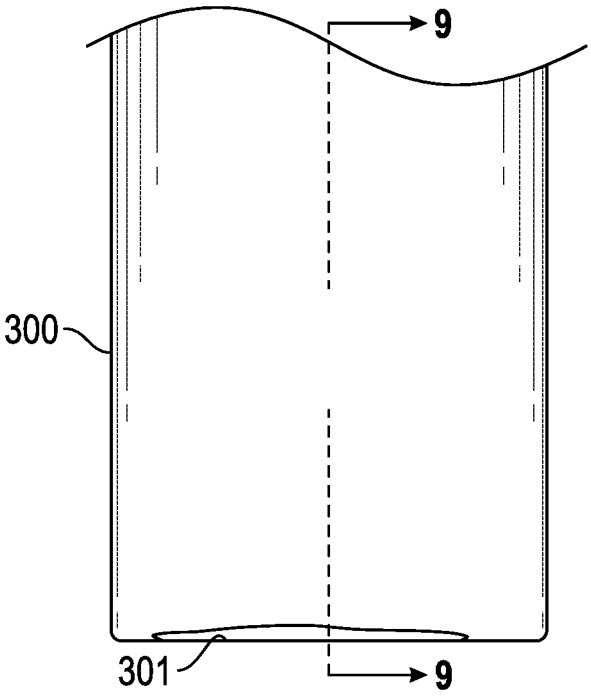
FIG. 3 is a side elevation view of the vessel cooling system illustrated in FIG. 1.
Figure 4:
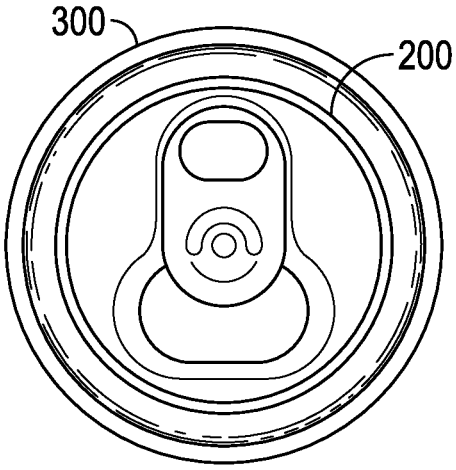
FIG. 4 is a top plan view of vessel cooling system illustrated in FIG. 1.
Figure 5:
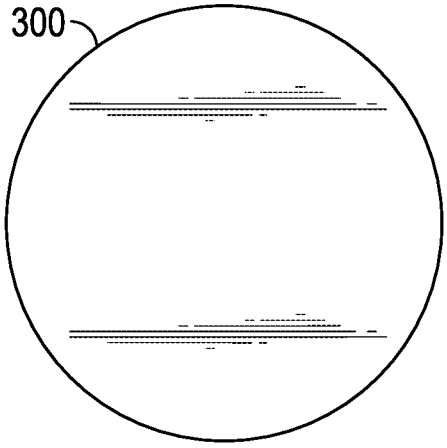
FIG. 5 is a bottom plan view of vessel cooling system illustrated in FIG. 1.

FIGS. 3-5 illustrate a koozie 300. One or more slit 301 may be formed in the bottom portion of the koozie 300. The slit 301 advantageously allows for the cooling device 100 to be readily inserted into the koozie 300 so that the cooling device may be positioned adjacent a bottom portion of the beverage vessel 200.

Figure 6:
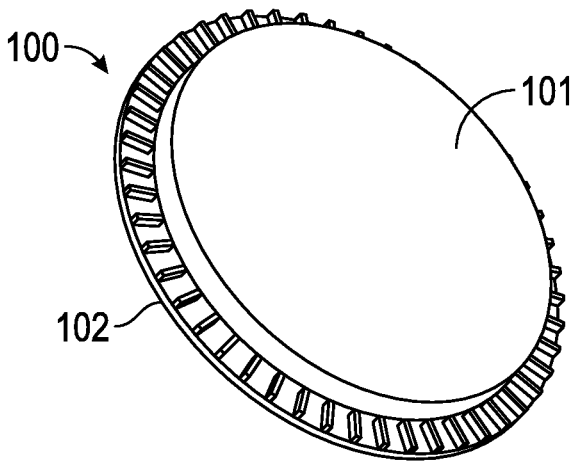
FIG. 6 is a perspective view of a cooling device of the vessel cooling system illustrated in FIG. 1.
Figure 7:
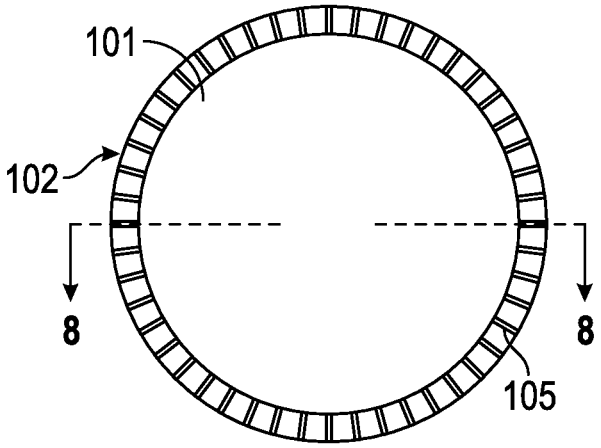
FIG. 7 is a top plan view of the cooling device illustrated in FIG. 6.
Figure 8:
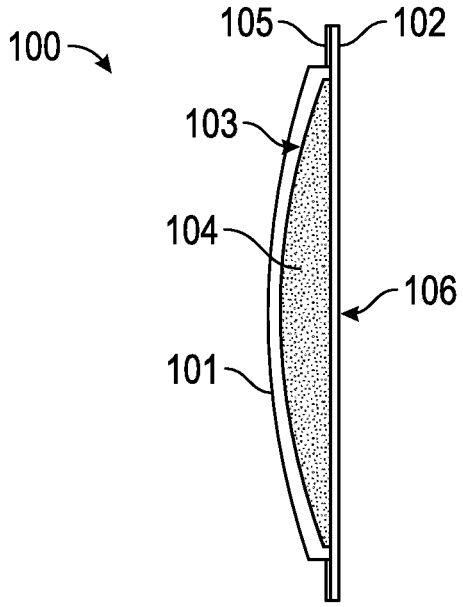
FIG. 8 is a side cross sectional view of the cooling device according to the present invention and taken through line 8-8 in FIG. 7.

FIGS. 6-8 illustrate an exemplary embodiment of the cooling device 100 according to an embodiment of the present invention. The cooling device 100 includes a main body 101 having a shaped design to conform to the bottom of a particular type of beverage container, in this case an aluminum can. The cooling device 10 may have an essentially circular perimeter and may have a convex top sized to be received in the bottom of a beverage can. By way of example, and not as a limitation, the top of the cooling device 10 may be configured to be received by the bottom of an aluminum can.

The cooling device 100 may also include a lip 102 formed around a circumference of the cooling device 100. The main body 101 forms a cavity 103 in which a coolant 104 is placed. The main body 101 may be formed of a pliable thermoplastic, or other similar materials, which may allow good thermal transmission and flexibility. In addition, exemplary embodiments of the cooling device 100 may include a relatively rigid portion 106 on at least one side of the main body 101, such as a nylon washer, flat plastic portion, etc. to allow the cooling device to remain relatively flat on one side (or portion of a side) once frozen.

Those skilled in the art will appreciate that the rigid portion 106, i.e., the bottom portion of the cooling device 100, is preferably a nonslip material. More specifically, the rigid portion 106 may, for example, be a neoprene material, or may simply be a rubber or neoprene washer that is adapted to be connected to a bottom portion of the cooling device 100. This advantageously enhances use of the cooling device 100 by preventing slippage of the cooling device when carried within a koozie 300. Accordingly, when positioned in the koozie 300, the cooling device 100 is preferably kept in place which, in turn, prevents the beverage container that is positioned on top of the cooling device 100 and one and the koozie 300 from moving about therein.

The coolant 104 is not particularly limited and may be water/ice or any other liquid or pliable material such as a gel, suspension, etc. In an exemplary embodiment, the coolant 104 can include a hydro-gel, a mixture containing a hydro-gel, water and hydro-gel, etc. While coolant 104 can be frozen or cooled inside the main body 101 before use, it is also possible to use other cooling principles, such materials which undergo an endothermic reaction (e.g., crystallizing based, etc.), to provide a heat dissipating effect. Those skilled in the art will appreciate that any coolant 104 is contemplated to be used by the cooling device 100 while still accomplishing the goals, features, and objectives of embodiments of the present invention.

The material which the main body 101 is formed of is not intended to be limited. In an exemplary embodiment, the main body 101 can be formed of a soft plastic material such as urethane. For example, thermoplastic polyurethane is a very thin material, which provides less material through which to conduct heat from the beverage container 200 to the coolant 104 carried within the cooling device 100. Thermoplastic polyurethane also has desirable heat transfer characteristics. The main body 101 of the cooling device 100 may be formed of two sheets of thermoplastic polyurethane, or other pliable heat conducting materials, and sealed with the coolant 104 within. The sealing method may vary and can include thermal sealing, radio frequency welding, pressure welding, adhesive, etc. Similarly, the rigid portion 106 can be attached to the main body 101 by any of the above methods.

In an embodiment of the vessel cooling system 90 according to the present invention, the rigid portion 106 of the cooling device 100 can form the bottom of the cooling device and the lip 102 may be formed on a circumference of the rigid portion 106. In addition, in some embodiments the coolant 104 may be disposed between the rigid portion 106 and main body 101.

Because the cooling device 100 may be pliable, when the coolant 104 begins melting, the beverage container 200 may push down on the cooling device 100. This can create a vacuum effect which then causes the cooling device 100 to adhere itself to the bottom of the beverage container 200. At this point no object, such as a koozie 300, is needed to hold the cooling device in place as a vacuum/suction effect has been developed between the beverage container 200 and the koozie 300.

Raised ridges 105 may be disposed along the rigid portion 106 or on a lip 102 formed on the edge of the rigid portion 106. The raised ridges may act to increase friction between the cooling device 100 and the beverage vessel or beverage container 200. Additionally, the raised ridges 105 may act as reservoirs and collect condensation that collects on the can. The collection of this condensation may serve to aid in creating a vacuum seal between the cooling device 100 and the beverage vessel. Allowing the condensation to collect in the raised ridges 105 may also keep the condensation away from the beverage vessel thereby assisting in preventing the beverage from rising in temperature. This is due to the fact that the collection of condensation is a leading factor in causing the metal walls of a beverage vessel to rise in temperature, which in turns increases the temperature of the beverage within the beverage vessel.

Additionally, the coolant 104 can be formed of a material that contracts when changing from the solid/frozen/cold state to a liquid/warm state. For instance, water expands when frozen and contracts when thawed. This property can also help in creating a deformation in the main body 101 to further promote a vacuum seal between cooling device 100 and the beverage container 200.

Figure 9:
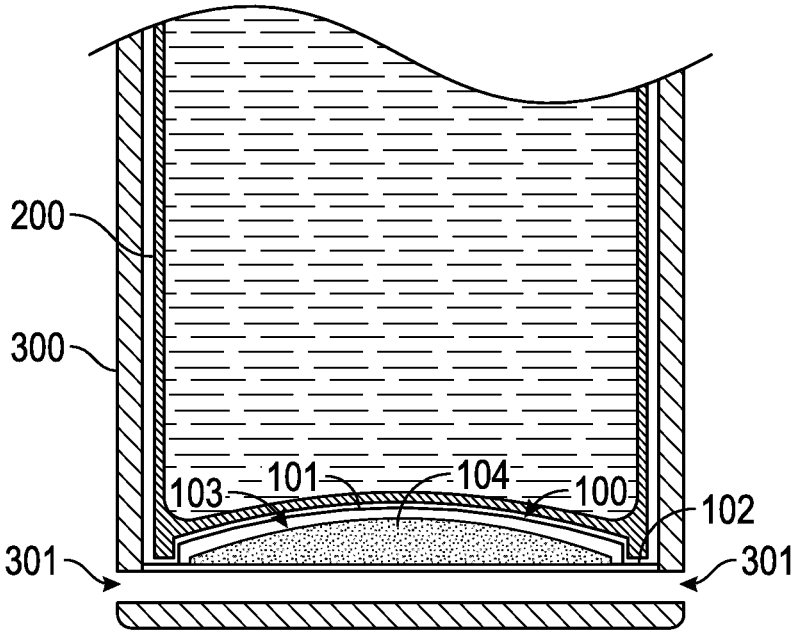
FIG. 9 is a partial side cross sectional view of the vessel cooling system according to the present invention and taken through line 9-9 in FIG. 3.

FIG. 9 illustrates an exemplary embodiment of the cooling device 100 held between koozie 300 and the bottom portion of the beverage container 200. As can be seen in FIG. 9, the main body 101 has conformed to the shape of the bottom of beverage container 200.

Figure 10:
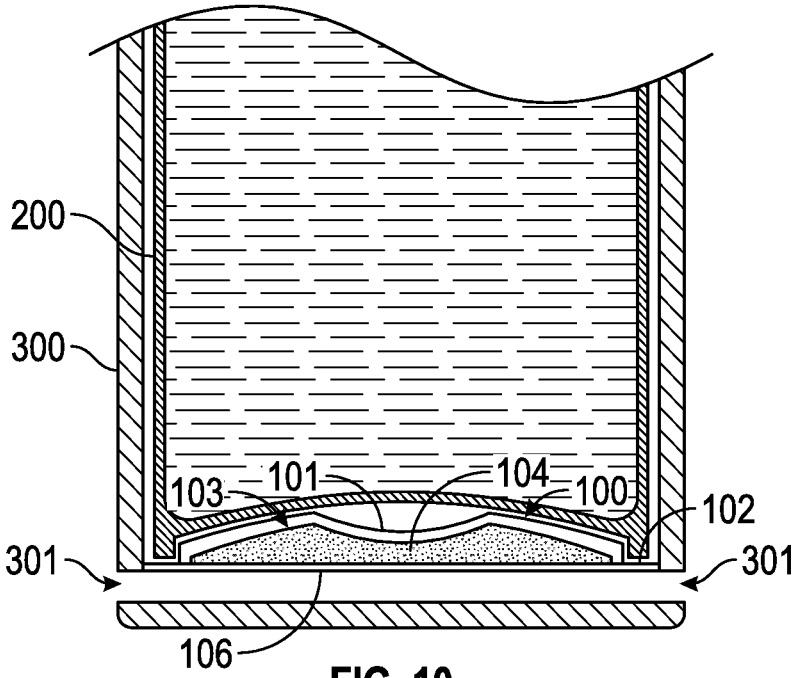
FIG. 10 is a partial side cross-sectional view of the vessel cooling system illustrated in FIG. 9 and showing the cooling device 100 and a deformed position.

FIG. 10 illustrates the cooling device 100 once a deformation has formed on the main body 101 (due to pressure from the can 200, contraction of the coolant 104, etc.). The depression in the main body 101 may cause a suction effect between the cooling device 100 and beverage container 200. The lip 102 and ridges 105 can also act to ensure proper suction is achieved.

Because the main body 101 of the cooling device 100 is pliable, the main body 101 can deform to match the bottom surface of the beverage container 200. Because the main body 101 can conform to the shape of the bottom of the beverage container 200, more surface area of the main body 101 is in contact with the beverage container 200. Thus, conductive thermal transmission is increased in comparison to devices which may not contact as much of the bottom of the beverage container 200.

Although the illustrated embodiment of the cooling device 100 is shown as having a bottom portion and an upper portion defined as the cavity 103, and that the bottom portion is substantially flat and that the cavity is curved, those skilled in the art will appreciate that the cooling device 100 may have any shape while still accomplishing the goals, features and objectives according to the present invention. More specifically, it is contemplated that the bottom portion of the cooling device 100 need not be flat or rigid, but may be formed by a bottom portion of the cavity which is deformable. Accordingly, it is contemplated that the shape of the cooling device 100 may be provided by a top portion having a similar shape as the bottom portion. In other words, the main body 101 of the cooling device 100 may be defined as the cavity so that the cooling device may be provided without the bottom portion which includes the lip 102 having the raised ridges 105 and the rigid bottom portion 106.

The main body 101 can be formed to include a shaped depression in the center or so as to have areas or lines of greater flexibility/rigidity to encourage deformation into a certain shape upon melting of the coolant 104 or pressure on the main body 101 in order to facilitate the forming of a suction between the beverage container 200 and the cooling device 100.

In some exemplary embodiments, a thermoplastic polyurethane or similar material can be made somewhat transparent to allow a user to observe when the coolant 104 has melted. Additionally, because the material may be soft or flexible it can allow the user to squeeze or touch the cooling device 100 to determine if the coolant 104 has melted.

The lip 102 may be formed of the same (or similar) material as that of the main body 101 and may be formed integrally with the main body. In some embodiments, the lip 102 may be formed on the rigid portion 106. In the exemplary embodiment of FIG. 1, the cavity 103 does not extend into the lip 102.

The lip 102 may include raised ridges 105 that are arranged in a pattern, but those skilled in the art will appreciate that the raised ridges 105 of a cooling device 100 need not be configured in any sort of pattern. For instance, the raised ridges 105 can include X shaped ridges, semi-spherical nubs, or any other shape. The raised ridges 105 of the cooling device advantageously provide stability. For example, in an embodiment directed to be used in connection with a beverage container that is an aluminum can, the lowermost portion of the can 200 rests directly on the ridges 105. The interaction between the lowermost portion of the can 200 with the ridges 105 provides a friction between the cooling device 100 and the can so as to prevent or minimize movement of the can when engaged with the cooling device. The raised ridges 105 also collect condensation, which assists in forming a vacuum with the beverage vessel and keeps the condensation from forming on the walls of the beverage vessel.

Figure 11:
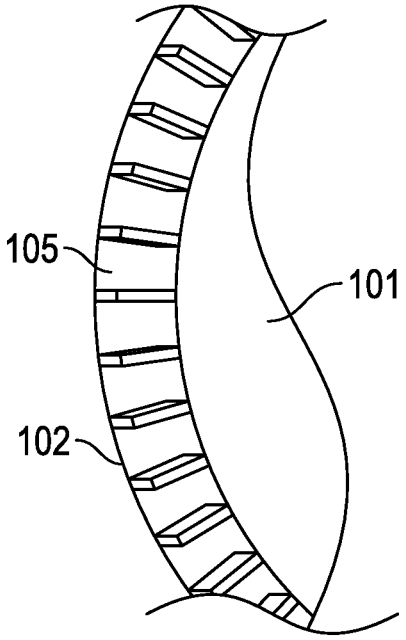
FIG. 11 is a partial view of a portion of a lip of the cooling device of the vessel cooling system according to embodiments of the present invention and showing a plurality of raised ridges thereon.

FIG. 11 illustrates an exemplary pattern for ridges 105. In some embodiments, the lip 102 can be shaped so as to promote a vacuum effect with the beverage container 200. The pattern of ridges 105 can also be formed so as to promote an adhesion between the beverage container 200 and the lip 102 and/or create a vacuum seal at the lip 102. In exemplary embodiments, ridges 105 may provide adhesion directly between the can 200 and the cooling device 100, and/or through a capillary action with water, and/or any other single or combination of adhesion types.

Although a pattern of raised ridges 105 showing pairs of ridges being aligned around the circumference of the lip 102 is illustrated, those skilled in the art will appreciate that the present invention contemplates the use of several different other patterns of raised ridges or random placement of the raised ridges while still conscious the goals, features and objectives according to embodiments of the present invention.

The overall diameter and pliability of the exemplary cooling device 100 of FIG. 1 allows the device to be slid into a slit that may be formed in the bottom of the koozies 300, and similar devices. Fitting the cooling device 100 through the slit 301 of a koozie 300, even when there is a can/bottle present, allows the cooling device 100 to be inserted and removed without causing undue stress on the koozie 300, or requiring the user to remove the beverage container 200 from the koozie 300.

While embodiments have been described in reference to use with an aluminum can, the invention is not limited to such application. The size, relative dimensions, and even shape of the main body 101 can be altered as needed to fit any desired container. Additionally, the lip 102 can be altered in shape to follow the bottom portion of the container which contacts the ground, table, etc. In some embodiments, the cooling device 100 can fit inside the slit 301 in the koozie 300 without further deforming the slit 301 in a lengthwise direction when a beverage container 200 is inserted in the koozie 300.

For example, the main body 101 can have a reduced profile when used with a beer bottle, as the recessed bottom is normally not as deep as that of an aluminum can. Similarly, the lip 102 can have a different length projected from the main body 101 to match the different bottom profile and ridges 105 can be adjusted to provide a better seal depending on the bottom texture/material. In some examples, the materials can be made more pliable and the lip 102 larger in relation to the main body 101 to allow for a larger deformation and coverage to achieve a seal.

Some embodiments may not be configured to obtain a seal to the container and may rely on a koozie 300 or other device to hold the cooling device 100 adjacent to the container. In some embodiments, the main body 101 can include a texture to help with adhesion to the bottom of the container.

By altering the shape and/or size of the cooling device 100, the cooling device 100 can be applied to nearly all beverage containers such as baby bottles, glass beer pitchers, plastic beer pitchers, kegs, plastic water bottles, wine bottles, soda cans, 12 oz. glass beer bottles, 40 oz. glass beer bottles, all canned energy drinks, etc., or any other container where it is desired to keep the contents cool throughout use.

A method of using the cooling device 100 may include, cooling the cooling device 100, applying cooling device to the bottom portion of the container (optionally this step can include sliding the cooling device through a slit 301 in a koozie 300 at which point the slit has a length less than a diameter of the bottom portion of the container when the koozie 300 is inserted through), and removing cooling device 101 (optionally by passing the cooling device through the slit 301 of the koozie 300, while the slit 301 has a length less than a diameter of the bottom of the container). It is contemplated that in some embodiments, the slit 301 of the koozie 300 may have a length that is larger than the diameter of the cooling device 100. In such a case, it would be desirable to provide a closure mechanism on the koozie 300 to prevent the cooling device 100 from falling out of the koozie. Such a closing device may, for example, be a strap that may engage a sidewall of the koozie using, for example, a hook and loop type fastener. Other types of fasteners are contemplated by the present invention, as will be understood by those skilled in the art.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments failing within the scope of the disclosure. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A vessel cooling system comprising:

a beverage holding device, having a bottom with a slit having a length, that is adapted to contain a beverage vessel having a concave bottom with a perimeter; and a cooling device, having a convex top configured to be received by the concave bottom of the beverage vessel when the beverage vessel is contained by the beverage holding device, a bottom, and a diameter smaller than the length of the slit, disposed between the bottom of the beverage holding device and the beverage vessel further comprising:

a top sheet of thermoplastic polyurethane, a bottom sheet of thermoplastic polyurethane affixed to the top sheet of thermoplastic polyurethane forming a cavity therebetween, and a shaped depression in the center of the convex top, a rigid portion, having a circumference, disposed on the bottom sheet of thermoplastic polyurethane, a lip, having an upper surface with a plurality of raised ridges, formed on the circumference of the rigid portion and configured to contact the perimeter of the concave bottom of the beverage vessel, and coolant, that contracts as its temperature raises, contained within the cavity.

2. A vessel cooling system comprising: a cooling device having a convex top configured to be received by a concave bottom of a beverage vessel, a flat bottom, an annular perimeter, coolant contained between the convex top and the flat bottom, and a rigid portion connected to the flat bottom, located along an entirety of the annular perimeter, and comprising a lip, having an upper surface with a plurality of raised ridges formed on an surface of the rigid portion and configured to contact the perimeter of the concave bottom of the beverage vessel.

3. The vessel cooling system according to claim 2 wherein the cooling device further comprises a shaped depression in a center of the top.

4. The vessel cooling system according to claim 2 wherein the cooling device further comprises a lip having an upper surface with a plurality of raised ridges and configured to contact the perimeter of the concave bottom of the beverage vessel.

5. The vessel cooling system according to claim 2 wherein the cooling device further comprises:

a top sheet of thermoplastic polyurethane; and a bottom sheet of thermoplastic polyurethane affixed to the top sheet of thermoplastic polyurethane forming a cavity therebetween;

wherein the coolant is contained in the cavity.

6. The vessel cooling system according to claim 2 wherein the top is pliable.

7. The vessel cooling system according to claim 2 wherein the rigid portion is secured to the flat bottom surface and is a nonslip material.

8. The vessel cooling system according to claim 2 wherein the rigid portion is a nylon washer.

9. A vessel cooling system comprising: a beverage holding device adapted to contain a beverage vessel having a concave bottom with a perimeter; a cooling device adapted to be contained by the beverage holding device, having a convex top and configured to be received by the concave bottom of the beverage vessel, a flat bottom, and an annular perimeter, the cooling device further comprising: coolant contained between the convex top and the flat bottom, and a rigid portion connected to the flat bottom, located along an entirety of the annular perimeter, and comprising a lip, having an upper surface with a plurality of raised ridges formed on an surface of the rigid device and configured to contact the perimeter of the concave bottom of the beverage vessel.

10. The vessel cooling system according to claim 9 wherein the beverage holding device has a bottom with a slit having a length larger than a diameter of the cooling device.

11. The vessel cooling system according to claim 9 wherein the cooling device further comprises a shaped depression in a center of the top.

12. The vessel cooling system according to claim 9 wherein the cooling device further comprises a lip, having an upper surface with a plurality of raised ridges and configured to contact the perimeter of the concave bottom of the beverage vessel.

13. The vessel cooling system according to claim 9 wherein the cooling device further comprises:

a top sheet of thermoplastic polyurethane; and a bottom sheet of thermoplastic polyurethane affixed to the top sheet of thermoplastic polyurethane forming a cavity therebetween;

wherein the coolant is contained in the cavity.

14. The vessel cooling system according to claim 9 wherein the convex top is pliable.

15. The vessel cooling system according to claim 9 wherein the rigid portion is secured to the flat bottom of the cooling device and is a nonslip material.

16. The vessel cooling system according to claim 9 wherein the rigid portion is a nylon washer.

* * * * *